US007522112B2

(12) United States Patent
Blickle

(10) Patent No.: US 7,522,112 B2
(45) Date of Patent: Apr. 21, 2009

(54) ROOF ANTENNA WITH PROTECTED ACCESS TO A FASTENER THROUGH THE COVER

(75) Inventor: Günther Blickle, Waldorfhaslach (DE)

(73) Assignee: Hirschmann Car Communication GmbH, Neckartenzlingen (DE)

( * ) Notice: Subject to any disclaimer, the term of this patent is extended or adjusted under 35 U.S.C. 154(b) by 90 days.

(21) Appl. No.: 11/489,703

(22) Filed: Jul. 19, 2006

(65) Prior Publication Data

US 2007/0040757 A1 Feb. 22, 2007

(30) Foreign Application Priority Data

Jul. 25, 2005 (DE) ..... 10 2005 035 252

(51) Int. Cl.
*H01Q 1/32* (2006.01)

(52) U.S. Cl. ..... 343/713; 343/715

(58) Field of Classification Search ..... 343/713, 343/715, 888, 906
See application file for complete search history.

(56) References Cited

U.S. PATENT DOCUMENTS 6,714,171 B2 * 3/2004 Haussler et al. ..... 343/888
7,088,297 B2 * 8/2006 Nakano et al. ..... 343/713
2003/0193440 A1 10/2003 Yang
2003/0231140 A1 12/2003 Haussler

FOREIGN PATENT DOCUMENTS

| | | |
|---|---|---|
| EP | 0 795 921 | 9/1997 |
| FR | 1 337 386 | 9/1963 |
| FR | 2 802 023 | 6/2001 |

* cited by examiner

*Primary Examiner*—Shih-Chao Chen
(74) *Attorney, Agent, or Firm*—Andrew Wilford

(57) ABSTRACT

A roof antenna (1) for vehicles is provided with a base plate (14) on which antenna elements (12, 13) are arranged or which has at least one contact element (15) for an antenna element, a cover (2) of the roof antenna (1) being provided with at least one opening (6) through which a fastening means can be inserted and through which the fastening means can be countersunk at the side opposite to the surface of the cover (2) in order to fasten the roof antenna (1) on a vehicle body, particularly on a vehicle roof (3) or in order to fasten the cover (2) on the base plate (14), where, according to the invention, a closure (4) can be inserted into the opening (6) subsequent to the insertion of the fastening means into the opening (6) and to the unmovable fixation of the roof antenna at the vehicle body.

22 Claims, 10 Drawing Sheets

ROOF ANTENNA WITH PROTECTED ACCESS TO A FASTENER THROUGH THE COVER

FIELD OF THE INVENTION

The invention regards a roof antenna with a cover for installation on a vehicle body having a base plate on which are mounted antenna elements at least one of which has a contact element (15) for an antenna element, a cover of the roof antenna formed with at least one opening through which a fastening means can be inserted and in which the fastening means can be countersunk at the side opposite to the surface of the cover to fasten the roof antenna to a vehicle body, particularly on a vehicle roof, or in order to fasten the cover on the base plate.

BACKGROUND OF THE INVENTION

Roof antennas for vehicles having a base plate on which antenna elements or modules are arranged are known. In order to protect these elements against external influences such as water, mechanical influences (particularly streams of air) and the like a cover (also called protective hood or cap) is provided. The cover of a roof antenna can be fastened in known manner on or at the base plate by means of several screws that are vertically screwed into complementarily threaded bosses in the cover from below near the outer edge of the base plate or the cover. This method for fastening the cover has the disadvantage that the number of the screws and thus the fabrication efforts for mounting are relatively high (usually five to seven or more screws) and that the cover construction is complex and difficult as far as the design is concerned. Visually disturbing marks (sink marks), caused by plastic contraction, particularly in the region where the vertical bosses merge with the visible outer surface of the cover, cannot be avoided. Moreover, once the roof antenna is installed on the vehicle, it is impossible to simply remove the cover and to exchange it, since then the screws are covered from below by the vehicle body and are only accessible if the antenna is taken off.

The method shown in FIG. 8 for fastening the roof antenna cover, where the disadvantages mentioned above are avoided, is known. There, rather than a plurality of screws, only one central screw is used to secure the cover to the base plate from above (if necessary by providing an additional spacer between the cover and the base plate, as shown). Thus, the screwing of the cover onto the base plate is less complex, the construction of the cover is simpler and sink marks do not pose any problem, since no further screwing bosses in the cover are required. With this kind of fastening method, the cover can be simply unmounted even when the roof antenna is installed on the vehicle, since the screw is freely accessible from the outside.

Such fastening means that are visible from the outside, freely accessible and unprotected, are disadvantageous, however, since the screw head that is visible from the outside and the recess in the cover required, in which the screw head is inserted, considerably disturb the visual impression of the roof antenna as a design element and are therefore undesirable. Moreover, such visible and freely accessible fasteners incite unauthorized persons to remove the roof antenna or the cover without permission, either for purpose of theft or vandalism. Furthermore, there is a certain risk that humidity might get into the inside via the opening in the antenna cover, particularly if the screw head is countersunk in a recess in the cover and rain water accumulates in this recess.

Also, dirt that is hard to remove from the cavity accumulates very easily in such recesses and interferes with access to and/or the operation of the fastener. Thus, if dirt accumulates for example in the hex or torx socket of a cylinder screw, the use of a corresponding tool is no longer possible.

The roof antenna itself can be usually fastened on the body of a vehicle by means of a threaded stem formed on the bottom face of the base plate. The stem extends through a complementarily shaped hole in the vehicle body when the roof antenna is put on the vehicle body from above or from the outside, and afterward a special annular gear nut is screwed on the stem from below or from the inside of the vehicle. Additionally, other versions are known, where a screw with an adequate plain washer for fastening the roof antenna from below is used instead of the nut, as can be seen in FIG. 8. These fastening methods have the disadvantage that the roof antenna, when installed from above, has to be screwed on from the inside of the vehicle body, so that a change of position of the installer is necessary so that the installation process thus becomes unnecessarily laborious, or so that even two installers might be required. Additionally, when the roof antenna is to be removed at a later date, the roof lining in the passenger compartment has to be removed for access to the screws; a fact that unnecessarily complicates later removal of the roof antenna.

A simple and known possibility for fastening a roof antenna to a vehicle body by simply screwing it on from above is shown in FIG. 9. The screw head can be more or less countersunk in the cover. The screw extends to the sheet metal of the vehicle body and is screwed into a thread in the sheet metal. In the simplest case, only a round hole in the sheet metal is required and the screw autonomously forms its thread when the roof antenna is screwed on. Similarly to FIG. 8, an additional spacer may serve for reducing the required screw length, particularly if the screw head is to be provided within the area of the cover surface. Instead of a central screw, several such screw connections might be used. The disadvantages, however, of such a fastening means, which is visible from the outside, freely accessible and unprotected, are the same as the disadvantages already described above.

OBJECT OF THE INVENTION

Therefore, the object of the invention is to provide the fastening of a complete roof antenna on a vehicle body, or the fastening of a cover on the base plate or on other parts of a roof antenna by means of at least one fastener that can be operated from the outside of the vehicle body by means of a tool, so that the above-described disadvantages are avoided.

SUMMARY OF THE INVENTION

According to the invention, a closure can be inserted into the opening after the fastening means were fitted through the opening and after the roof antenna was fixedly installed on the vehicle body. Alternatively, a closure can be inserted into the opening after fixation of the cover onto the base plate of the roof antenna.

Thus, access to the fastening means is visually advantageous, either because it does not attract any attention at all or because the attention attracted is a positive attention, due to the fact that the closure is incorporated in the visual appearance and the lines of the roof antenna or its cover. Removal of the roof antenna or the cover by unauthorized persons is complicated by the fact that the fastening means are visually hidden and designed such that special knowledge and auxiliary means are required for accessing the fastening means.

The interior of the roof antenna is reliably protected against entry of humidity or dirt and no depression, especially no cavities, are formed on the cover to collect humidity or dirt. It is an additional advantage that the fastening can be produced at low cost and with little effort as far as the installation is concerned. In addition, the fastening means can be easily installed and removed by persons with the right knowledge and appropriate tools.

In one embodiment of the invention, an access passage that leads toward the inside of the cover is formed on the cover, receiving the fastening means and determining its final position. The fastening means, preferably a screw, is recessed in the cover at least to such an extent that it can be inserted into the access passage sufficiently far that the closure can extend into the opening of the access passage when the roof antenna is being installed. The closure in its installed position as intended is exactly adapted to the surface shape of the cover with its exterior surfaces, which means that the surface of the closure and the surface of the cover are continuous after the installation of the closure. No depression in which water or dirt could accumulate is formed in the surface of the cover and likewise no material projections above the cover surface are formed to which a tool, such as a gripper, a screw driver or the like could be applied in order to remove the closure. It is therefore optimally incorporated into the roof antenna surface as far as design and line are concerned and the fastener is inconspicuously covered, which means that anyone who is not skilled in the art would not realize that access to a fastener is hidden under the closure. Additionally, it is not obvious that and how the closure can be removed, which results in a good passive protection against unauthorized removal.

This installed position, as intended, in the cover of the closure can reliably be achieved by simply pressing the closure manually into the access passage. For that purpose, the closure and the access passage are provided with mechanical abutments for limiting the axial insertion path and with guides or with elements for encoding the position for avoiding a distorted installation. The safe support of the closure in the intended, installed position (final position) within the access passage is realized by form-fitting elements, such as for example interlocking elements or the like on the closure and/or in the access passage, that interlock when the final position is achieved; and/or by sufficient frictional engagement between the wall of the access passage and the closure, which for this purpose can be at least partially made of rubber or an elastomeric material with a high coefficient of friction and, if necessary, it may be oversized, such that a force fit of the closure in the access passage is achieved when it is pressed in place.

A further embodiment of the invention provides a seal arranged between the closure and the cover. For example, the closure and/or the access passage contain one or several sealing elements, such as for example O-rings or integral seals, which in the installed position of the closure within the access passage as intended, reliably seal the latter and the whole roof antenna against penetration of humidity and dirt. These sealing elements and the interlocking or frictional elements can be advantageously formed by the same element.

A further embodiment of the invention provides a closure or its visible surface area that has a design corresponding to the surface of the cover, as far as material, color and surface design are concerned, provided it is not supposed to stand out. Alternatively, the closure or at least its visible surface is designed suitably differently to the cover surface, as far as material, color and surface design are concerned, when it is supposed to stand out. In particular the manufacturer's trademark logo in the form of a relief may be incorporated into the surface of the closure, if required, in combination with a high contrast color or painting, as for example silver on a black cover base. Furthermore, the closure and the access passage can be adapted to the form of a manufacturer's logo and thus have a round, polygonal, rhomboidal, crest-like or any other combined shape within the area of the upper visible surface.

The access passage is designed such that, on the one hand, it safely guides the tool for the operation of the fastening means (for example a torx screw driver or the like) to the fastening means (for example a torx head screw) when the roof antenna is installed and thus simplifies the installation and, on the other hand, such that it forms a mechanical barrier/shield, protecting the interior of the roof antenna and the electronic components contained therein against damage caused by contact with the tool. Furthermore, the access passage can be designed such that the fastener is held in the passage or in the base plate axially. For removal of the closure from the access passage (in order to subsequently remove the cover or the whole roof antenna) the restraint force described above has to be overcome. To this end, an exact knowledge of the construction is required and the use of tools, which on the one hand serve for protection against unauthorized removal and on the other hand allow the installer in the know to simply and rapidly remove the element, is required.

In a simple embodiment, a screw may be threaded into the center of the closure, thus allowing an application of a tool by means of which the closure can be pulled out of the access passage. In the same way, a special tool with handhold might be used ("cork screw" principle).

A further advantageous embodiment is a closure having a central hole through which a special pulling tool can be inserted. By the central bore hole in the surface of the closure, an existing passage in the closure can be uncovered, through which a special pulling tool is inserted into the closure. The pulling tool is connected to the closure (for example by interlocking or bolting) so that the closure can be pulled out of the access passage by operation of the pulling tool. When the central bore is subsequently closed by means of a plug (for example made of rubber) of adequate length and diameter, the closure can be used again.

A further advantageous embodiment provides a closure that is detachably or non-detachably connected to the cover after its insertion into the opening. This way, interlocking of the closure in the access passage is designed such that an encompassing "non-detachable" interlocking is created, that cannot be detached by the application of simple tensile force. Pulling tool, access passage and closure are created such that, when the pulling tool is inserted into the closure, an unlocking mechanism is activated and only thanks to this mechanism, it is possible to pull the closure out of the access passage again, where it had been tightly anchored before. When the roof antenna is screwed onto the vehicle body, a blind rivet nut, a rivet nut, an insert nut, a clip nut or the like can also be used as thread for the screw in a correspondingly designed section, in order to increase the stability of the thread connection compared to the direct screwing with the sheet metal.

BRIEF DESCRIPTION OF THE DRAWING

Roof antennas according to the state of the art and exemplary embodiments of the invention, which are in no way limiting, are described in the following and are illustrated by means of the figures. Therein.

SPECIFIC DESCRIPTION

Figure 1:
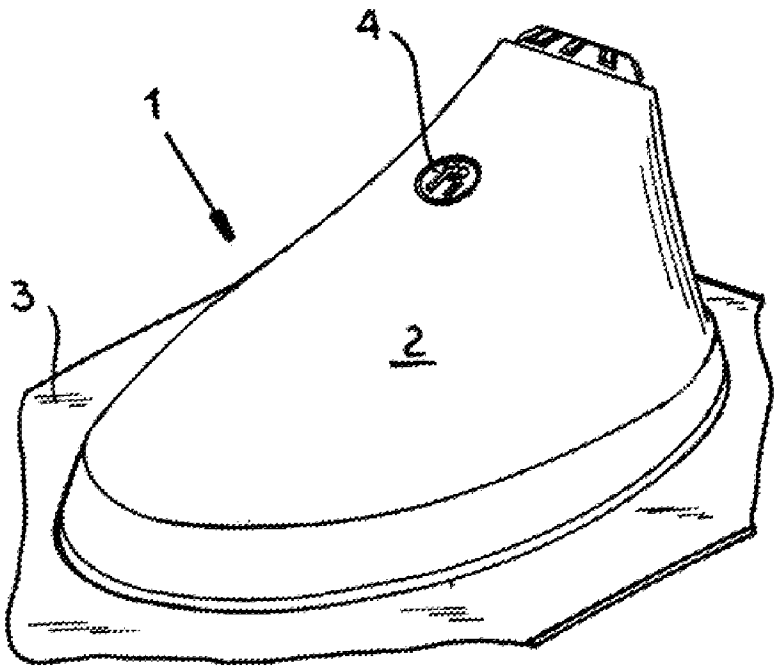
FIG. 1 shows a roof antenna with installed closure with a company logo.

FIG. 1 shows a roof antenna with installed closure provided with a company logo. The roof antenna 1 has a cover 2 and is installed on a vehicle body, which here and below consists of a vehicle roof 3. The installation of the roof antenna 1 on the vehicle roof 3 is carried out from above, to which end the cover 2 has an opening (not visible here) that is closed by a closure 4. In the described alternative application of the invention, the installation of the cover 2 on the base plate of the roof antenna 1 is also carried out from above, to which end the cover 2 is provided with an opening for a fastener, closed by a closure 4. On its surface the closure 4 has a company logo (here the company logo of the applicant), but it may also be any other logo or the like.

Instead of a company logo, the part of the closure 4 that is visible from the outside can consist of the same material and also of the same color and surface texture as the cover 2 or it may differ from it.

Figure 2:
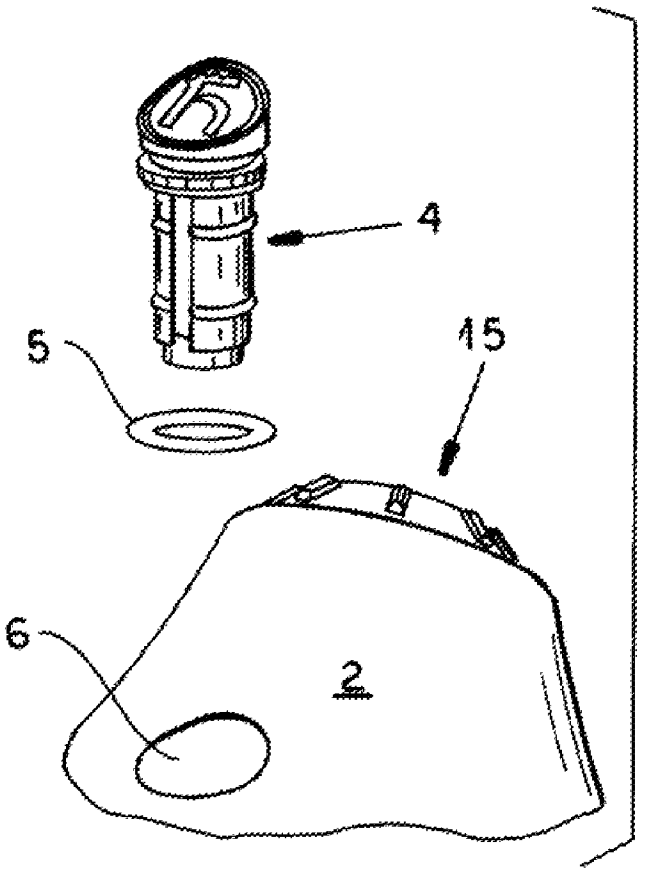
FIG. 2 shows a closure with orientation encoding and interlocking rings as well as with the sealing prior to installation.

FIG. 2 shows a closure with an orientation encoding and interlocking rings as well as a seal prior to installation. The closure 4 is inserted into an opening 6 in the cover 2 after fitting it with a seal 5, particularly an O-ring, subsequent to the insertion of a fastening means, particularly a screw, through the opening 6 and operation thereof by means of a tool and fixation of the roof antenna 1 on the vehicle roof 3 or of the cover 2 on the base plate. Since the cover 2 is complex in this embodiment, the closure 4 can be inserted into the opening 6 in only one position. For this purpose, orientation codings, e.g. in the form of longitudinal grooves, are provided, these longitudinal grooves corresponding to projecting ridges in an access passage of the cover 2 and allow the closure 4 to be inserted into the opening 6 in only one insertion position. Furthermore, interlocking means, such as interlocking rings, projections, interlocking hooks or the like are provided, by means of which the closure 4 is fixed, particularly detachably, in the access passage of the cover 2.

Figure 3:
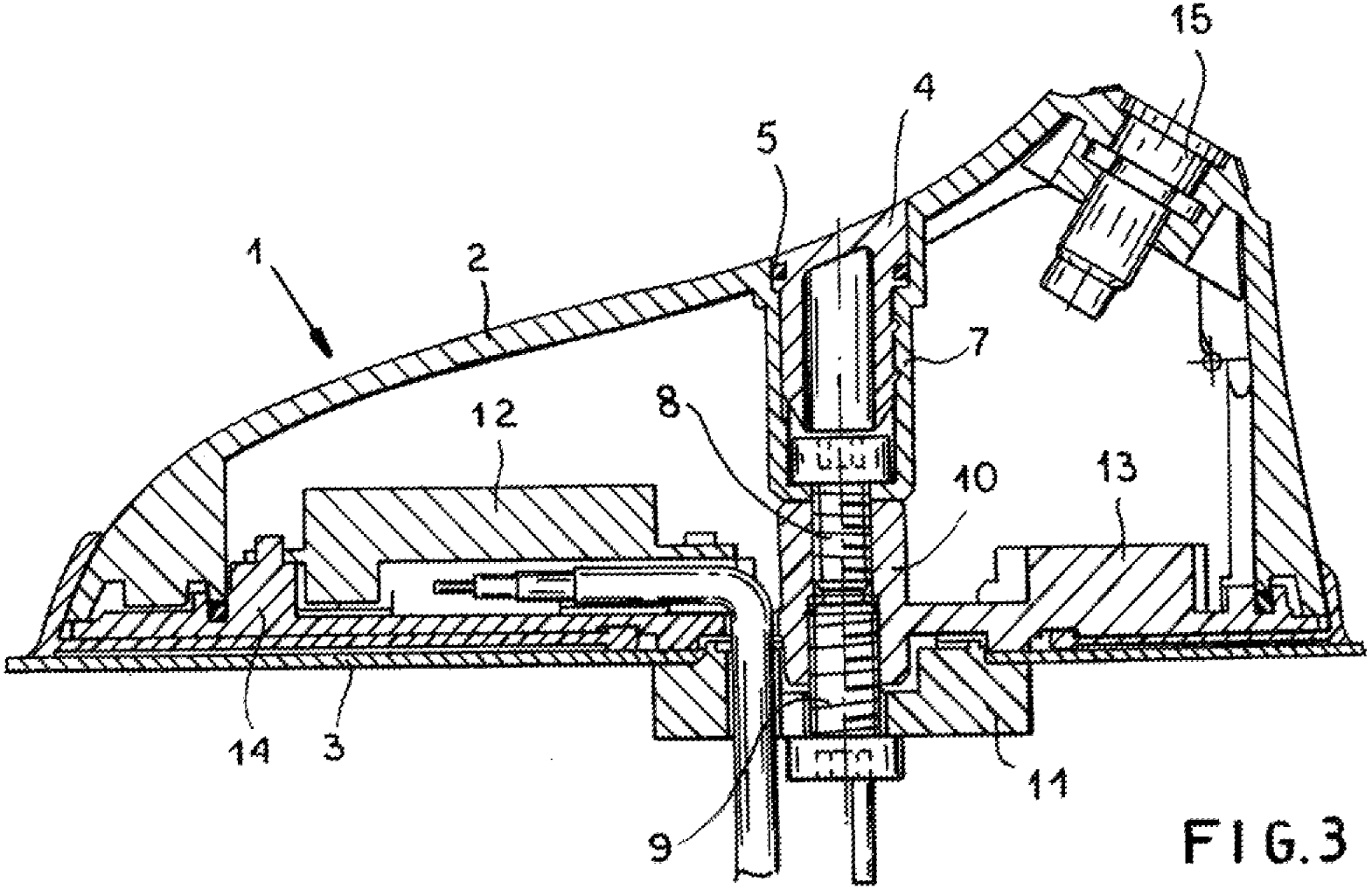
FIG. 3 shows a roof antenna with the cover centrally screwed on the base plate and the closure with O-ring shaped seal in the access passage.

FIG. 3 shows the roof antenna 1 with the cover centrally screwed on the base plate and the closure with O-ring seal in the access passage. In this sectional illustration one can see that the closure 4 was inserted into the opening 6 in one installation position, to which end an access passage 7 is formed below the surface of the cover 2. The access passage 7 together with the cover 2 may be made of plastic, for example by an injection-molding process. The screws 8 and 9 with a double-threaded tube 10 formed integrally with the base plate 14 are used as fastening means here, the screw 9 fixing the roof antenna 1 to the vehicle roof 3 by means of a clamping plate 11 and the screw 8 serving for the central fastening of the cover 2 on the base plate 14. Antenna elements shown at 12 and 13 are protected against exterior influences by the cover 2. A base plate 14 of the antenna bears on the vehicle roof 3 with its surface, if necessary with a seal provided in between. A contact 15 is provided for a further antenna element, particularly designed as an antenna rod.

Figure 4:
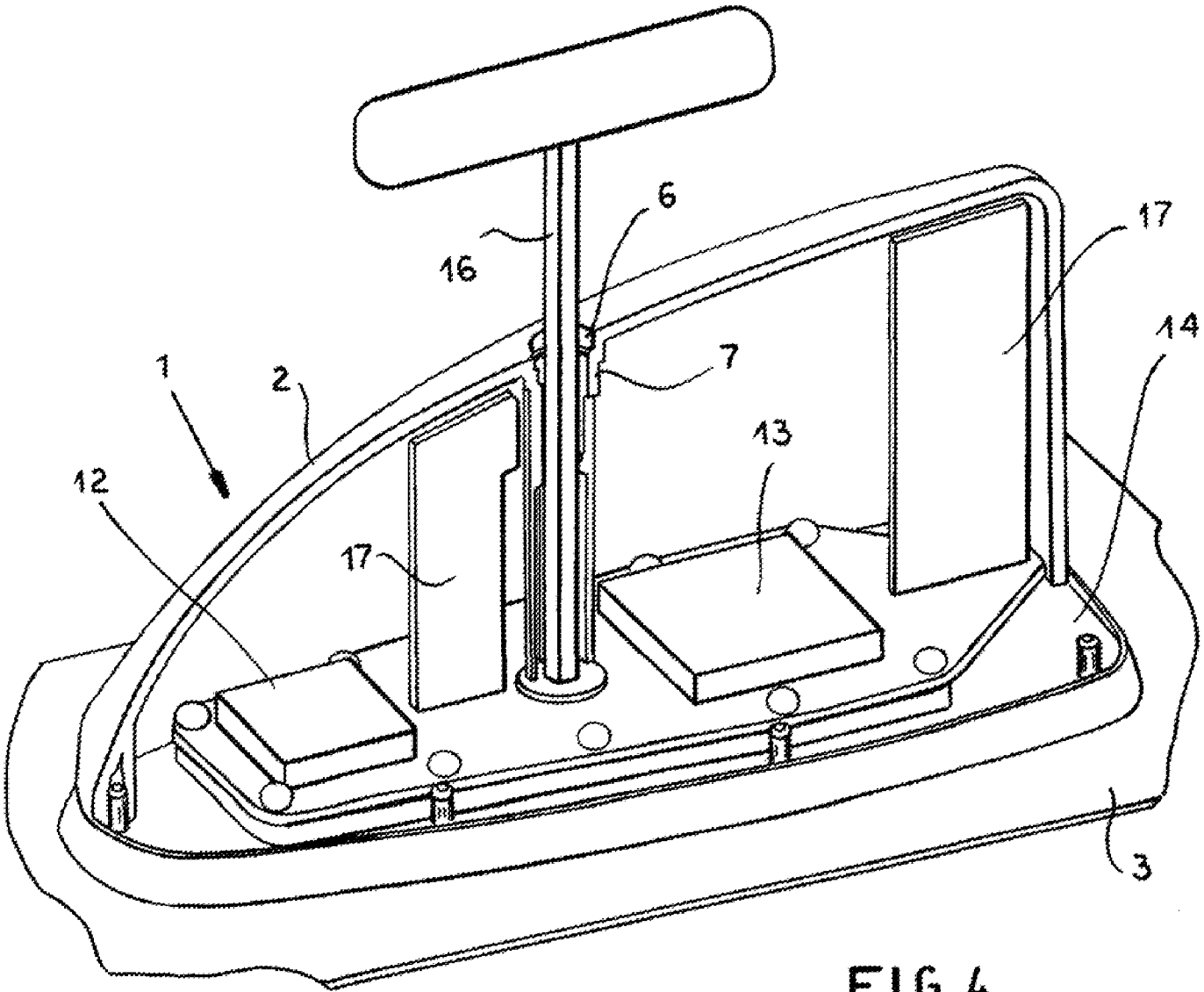
FIG. 4 shows a roof antenna, directly screwed on the vehicle roof with the screwing tool in operation.

FIG. 4 shows a roof antenna 1 directly screwed on the vehicle roof with a screwing tool in position. Here, it can be seen that a correspondingly designed screw driver 16 can be inserted through the opening 6 in the cover 2 in order to operate a screw 8 for reasons of installation or removal of the roof antenna 1. The access passage 7 is advantageously designed such that the tool is directly guided to the screw and protects the electronic components within the roof antenna 1 against accidental contact with the tool. Furthermore, the access passage 7 is of such a length that the screw can be easily turned after the cover 2 has been attached to the base plate 14, but is fixed axially in its access passage in the base plate 14. Below the cover 2 stiffening elements 17 are arranged that prevent the cover 2 from collapsing. These stiffening elements 17 are supported on the surface of the base plate 14 and/or on the bottom face of the cover 2 and are particularly advantageously formed on the bottom face of the cover 2 in one piece.

Figure 5:
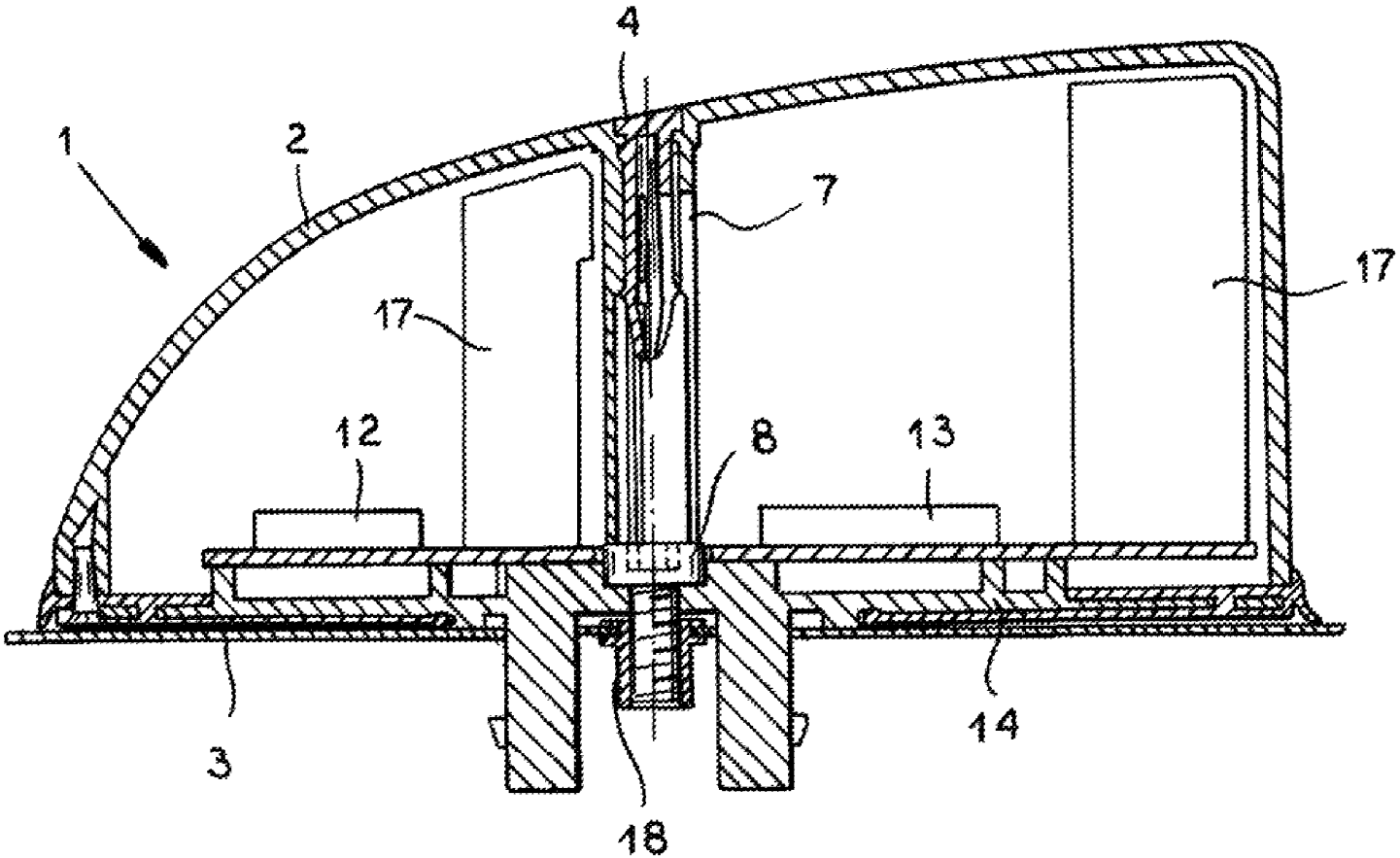
FIG. 5 shows a roof antenna screwed directly to the vehicle roof by means of a rivet nut and closure with seal, installed and interlocked in the access passage

FIG. 5 shows a roof antenna 1 screwed directly to the vehicle roof 3 by means of a rivet nut in the vehicle roof and a closure with seal installed and interlocked in the access passage. As mentioned before, the fastening of the roof antenna is not limited to the use of a rivet nut. Instead, if the thread is not directly formed in the roof metal sheet, any other threaded element can be used instead of the rivet nut, such as e.g. clip-in nuts, insert nuts, glued in or welded-in nuts. The closure 4 is designed such that it is unilaterally provided with interlocking arms that are inwardly chamfered and that lock in the access passage after being inserted into the opening 6. Before this, the screw 8 and a rivet nut 18 that was fixed in a corresponding opening in the vehicle roof 3 is operated by means of the installation tool 16. Thus, in this simple embodiment, first the roof antenna 1 can be fastened with or without the cover 2 on the vehicle roof 3 by means of the screw 8 and the rivet nut 18, before the opening 6 is closed by the closure 4. A particular embodiment can be seen in the fact that at first only the base plate with the antenna elements arranged thereon and further elements is fastened on the vehicle roof by means of the screw 8 and the rivet nut 18; the cover 2 is put on afterwards. The cover 2 is put on and above all fastened with the help of edge interlocking means, additionally the lower end of the access passage 7 is positioned such that it presses on the head of the screw 8, after the interlocking of the cover 2 on the base plate 14 in order to thus avoid that the screw 8 can be loosened again due to vibrations, variations in temperature or the like.

On the one hand, an access passage leading toward the inside of the cover is formed on the cover, receiving the fastening means and determining its final position. This is not absolutely required (see e.g. FIG. 4 and FIG. 5) in embodiments where the fastener is alternatively situated below the passage.

Figure 6A:
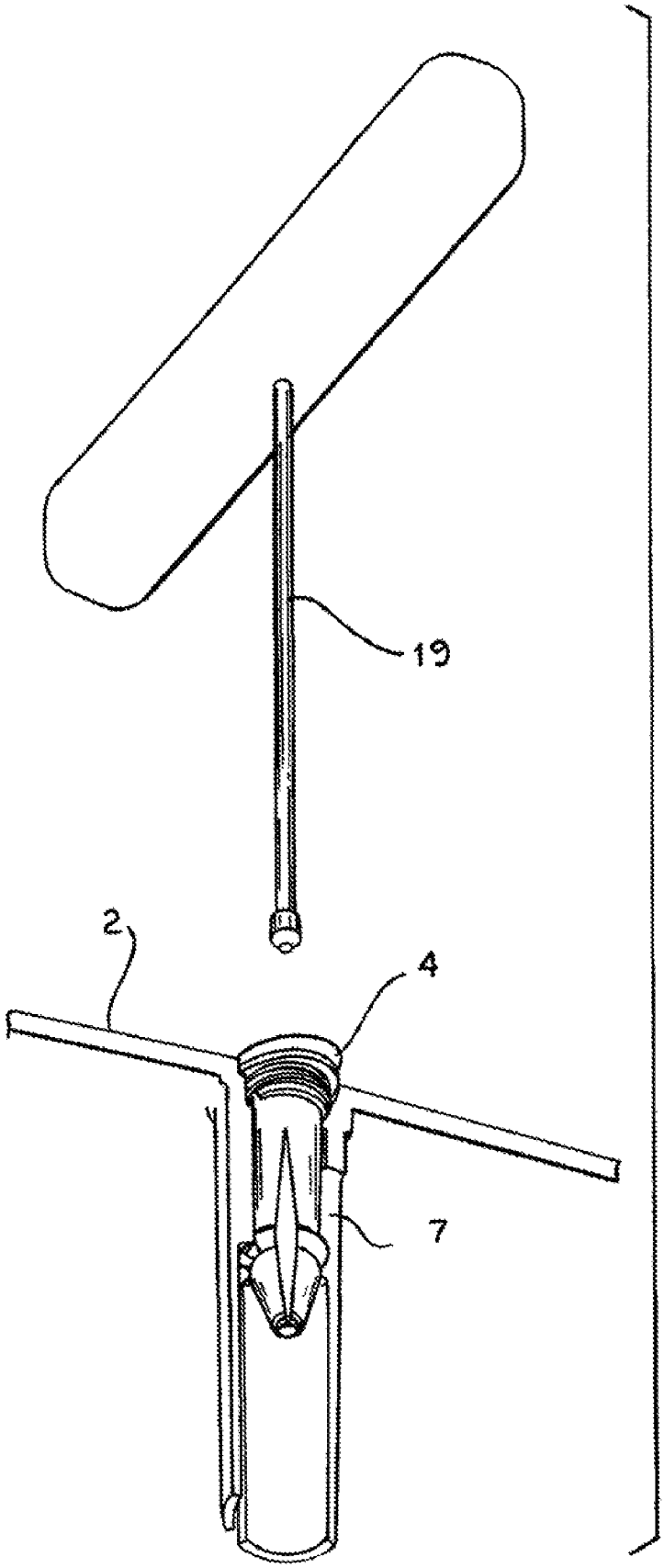
FIG. 6 shows a removal tool and its application.
Figure 6B:
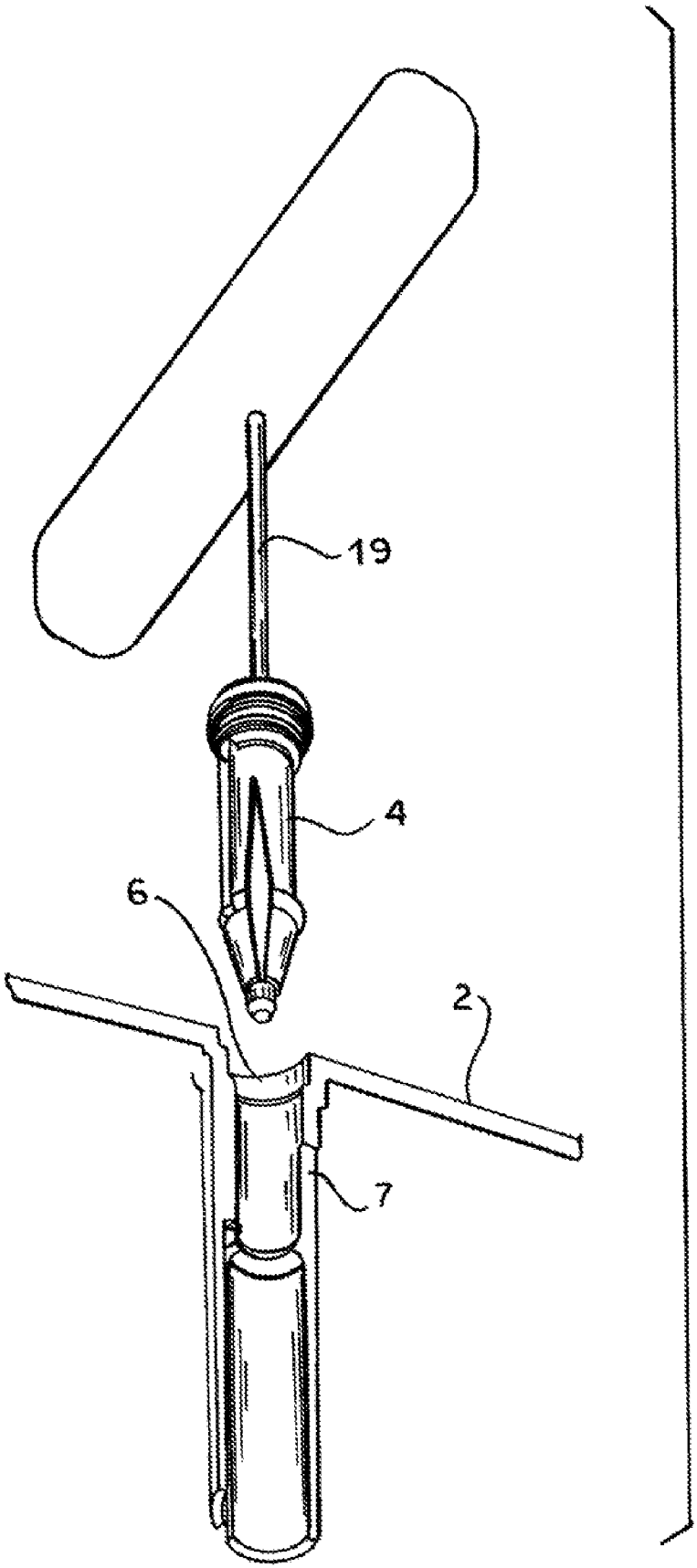

FIG. 6 shows a removal tool and its application. The left-hand illustration shows that the closure 4 is situated in the access passage 7 and is interlocked there. A removal tool 19 is shown prior to the interaction with the closure 4. The right-hand illustration shows that the closure 4 is drilled through from above because of its distance in order to ensure that the removal tool 19 can be inserted through the drilled hole until it abuts with the lower edge of the closure 4 and interlocks there. Subsequent to this process, the closure 4 can be pulled out of the access passage 7 under application of a correspondingly large force by means of an installation tool 19.

Figure 7A:
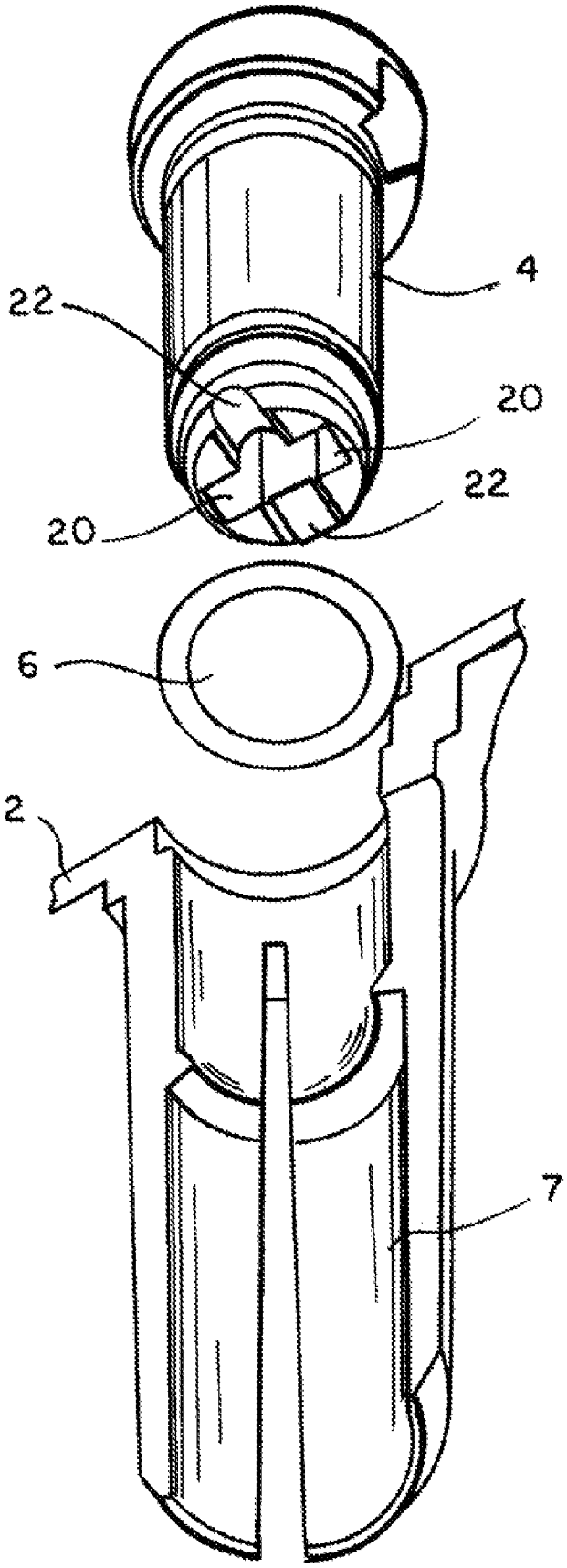
FIG. 7 is a detailed view of the closure and the removal tool.
Figure 7B:
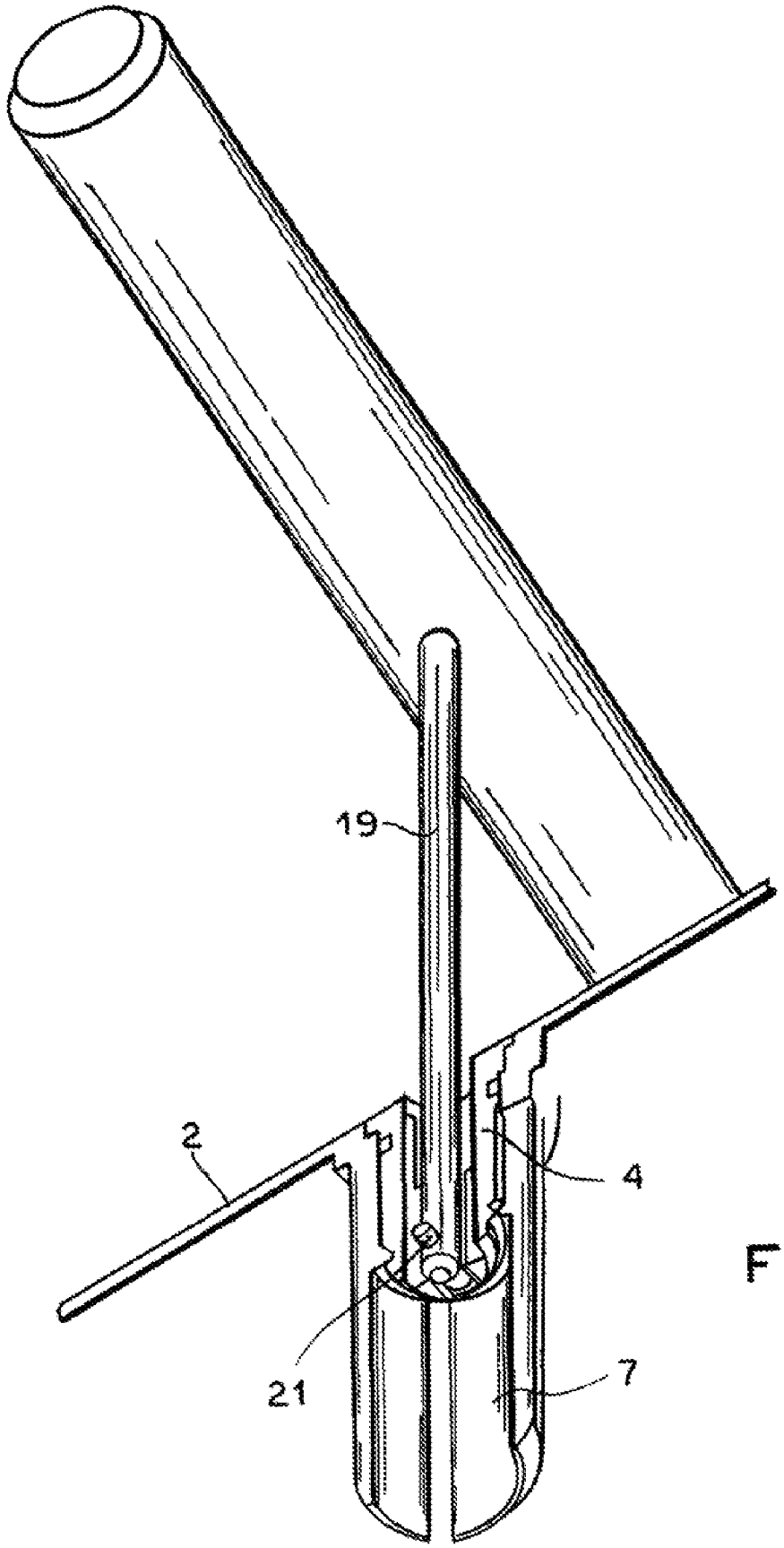

FIG. 7 shows detailed views of a closure designed differently from that of FIG. 6 and of the removal tool. In the left-hand illustration, it can be seen that the closure 4, which can be inserted into the access passage 7, is provided with at least one groove 20 on its inner side, particularly with two opposing grooves 20 extending over the whole length of the closure 4. Subsequent to the insertion of the closure 4 into the opening 6 and interlocking in the access passage 7, it has at first a continuously closed surface on its upper side in order to prevent water and dirt from penetrating as well as an unauthorized removal. The removal of the closure 4, i.e. by pulling it out of the access passage 7, is only possible if the surface of the closure 4 has been drilled through and the removal tool 19 has been inserted into the drilled hole. At its bottom end, the removal tool 19 is provided with two opposing pins 21 (see right illustration of FIG. 7) that can be move through corresponding grooves 20. When the pins 21 get below the lower edge of the closure 4, a slight turning movement, particularly a 90° pivoting of the installation tool 19 is sufficient to make the pins 21 engage under the lower edge of the closure 4 and thus the closure 4 can be pulled out of the access passage 7. In a particularly advantageous manner, the closure 4 has two pockets 22 at its lower end opposing each other, at the same level, and fittable with the pins 21 of the removal tool 19.

Figure 8:
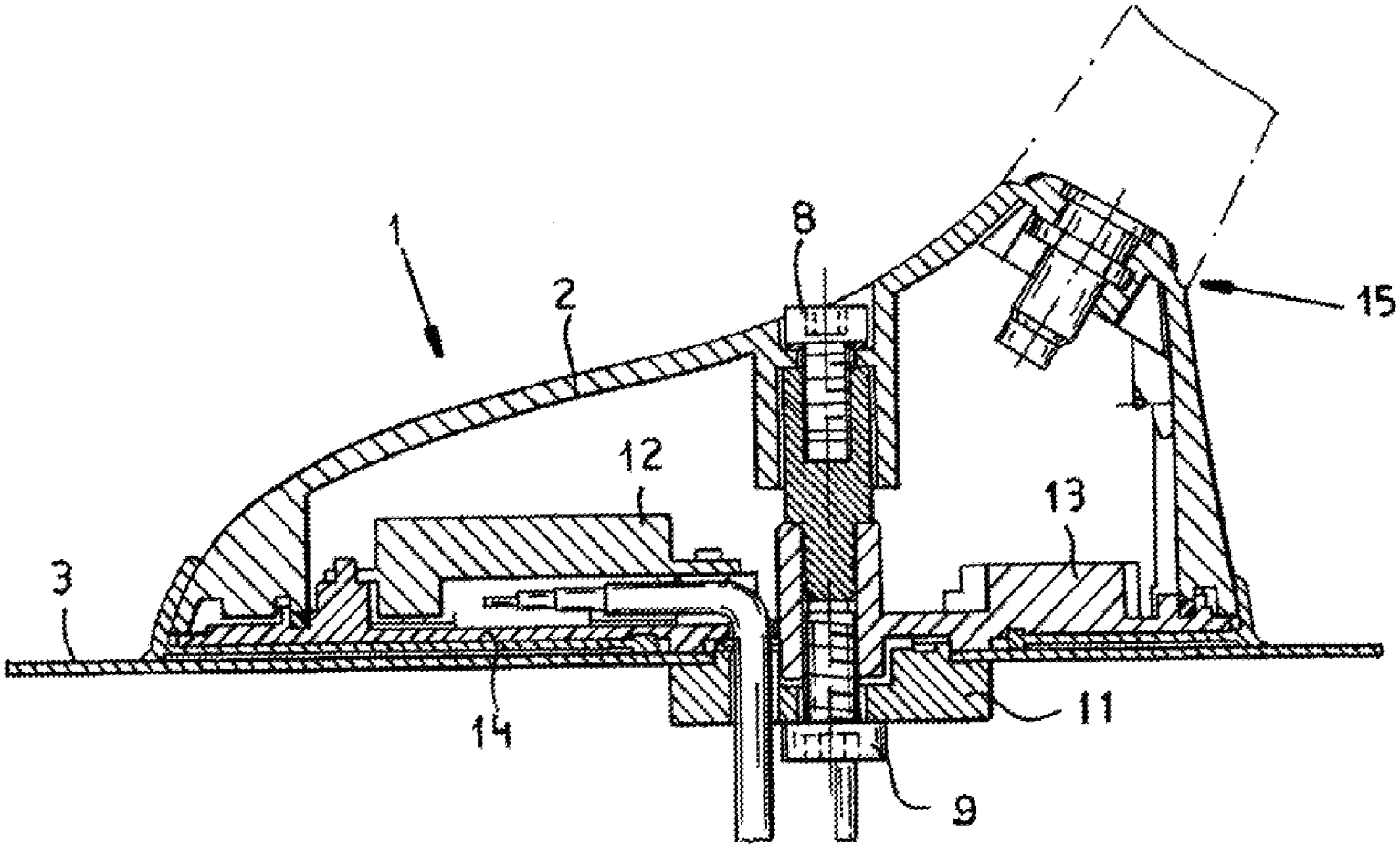
FIG. 8 PRIOR ART
FIGS. 8 and 9 show roof antennas according to the state of the art.
Figure 9:
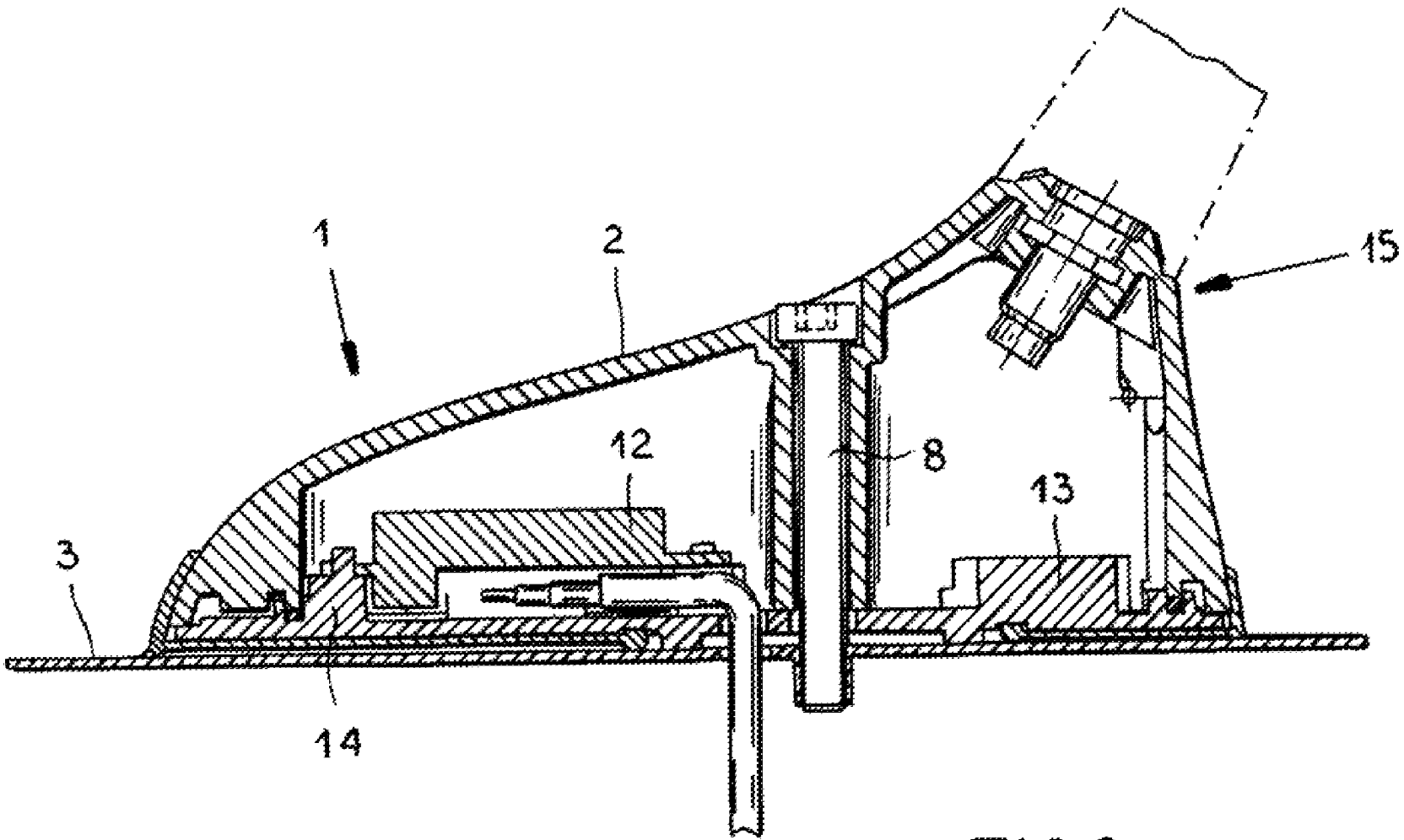
FIG.9 PRIOR ART

FIGS. 8 and 9 illustrate roof antennas according to the state of the art that already were discussed above and for which the same reference signs as those used in the preceding figures were used.

It should be noted that the fastening means described so far is a part for fixation and/or a removable tool for installation.

The bore hole, for at least a part of its length, can alternatively be drilled in later from the outside in case of removal.

The invention claimed is:

1. An antenna for mounting on a motor-vehicle roof, the antenna comprising:

a base plate on the roof;

antenna elements mounted on the base plate;

a cover fitting on the base plate over the elements and formed with an upwardly and downwardly open countersunk opening;

a fastener engageable in or through the base plate and having a head recessed in the cover at a base of the countersunk opening; and a closure separate from the fastener and releasably engaged in the opening outward of the head of the fastener.

2. The antenna defined in claim 1 wherein the closure and the fastener are of different materials and the material of the closure matches in appearance that of the cover.

3. The roof antenna according to claim 1 wherein surfaces of the closure and of the cover are for the most part arranged at a tangential side and without causing any offsets and thus merge with each other without contour edges, steps, overlapping areas or depressions, if the antenna is installed in the intended position.

4. The roof antenna according to claim 1 wherein with the exception of a small unavoidable gap caused by production tolerances, there is no region where water or dirt might accumulate between the closure, installed in its intended position, and the cover.

5. The roof antenna according to claim 1 wherein the closure in its intended position does not extend over the cover anywhere, does not project over it or does not bear on it with a flange and thus no point of application is given for manual removal or removal by means of a lever-type tool.

6. The roof antenna according to claim 1 wherein the opening forms an access passage that has an outwardly open large-diameter outer portion receiving the fastener.

7. The roof antenna according to claim 6, further comprising a removal tool, the access passage being designed such that a tool for fastening the fastening means can extend from outside through the passage to engage the fastener.

8. The roof antenna according to claim 7 wherein the cover is formed with a tubular part forming the access passage and preventing contact between the tool and the antenna elements on the base plate when the tool is fitted through the passage and engages with the fastening means.

9. The roof antenna according to claim 8 wherein the tubular part forming the access passage is unitarily formed on the cover.

10. The roof antenna according to claim 7 wherein the closure is provided with a central bore through which the removal tool can be inserted into the fastener.

11. The roof antenna according to claim 7 wherein the closure is provided with at least one axial groove and the removal tool with at least one pin that can be brought in active connection with the groove.

12. The roof antenna according to claim 7 wherein the closure and the access passage are provided with interlocking means.

13. The roof antenna according to claim 1, further comprising at least one seal between the closure and the cover.

14. The roof antenna according to claim 1 wherein interengaging formations are arranged on the closure and on the access passage that by their interaction determine the intended position of the closure in the access passage with regard to the rotational orientation around the longitudinal axis of the access passage.

15. The roof antenna according to claim 1 wherein interengaging formations are arranged on the closure and the opening forms an access passage that by their interaction determine the intended position of the closure in the access passage with regard to insertion depth.

16. The roof antenna according to claim 1 wherein interengaging formations are arranged on the closure and the opening forms an access passage causing an interlocking by interaction in the intended position of the closure in the access passage.

17. The roof antenna according to claim 1 wherein interengaging formations are arranged on the closure and the opening forms an access passage that in the intended position, by interaction, wedge the closure in the access passage.

18. The roof antenna according to claim 1 wherein the closure or at least its visible surface area matches the surface of the cover with respect to material, color and surface design.

19. The roof antenna according to claim 1 wherein the closure or at least its visible surface area are designed differently than the surface of the cover, as far as material, color and surface design are concerned.

20. The roof antenna according to claim 1 wherein the closure at its visible surface contains a relief, a print or any other flat arranged information or a pattern.

21. The roof antenna according to claim 1 wherein shapes of the opening of the cover and the closure within the section of its surface exactly fit into each other, and are of complementary shape.

22. A method of removing the closure of a roof antenna according to claim 1, in which a removal tool is interlocked or bolted with the closure before the closure is pulled out of the opening by means of the removal tool.

* * * * *